US006293862B1

(12) United States Patent
Jafine et al.

(10) Patent No.: US 6,293,862 B1
(45) Date of Patent: Sep. 25, 2001

(54) ROOF VENT

(75) Inventors: Paul Jafine; Michael David Jafine, both of Brampton (CA)

(73) Assignee: Dundas Jafine, Inc., Brampton (CA)

( * ) Notice: Subject to any disclaimer, the term of this patent is extended or adjusted under 35 U.S.C. 154(b) by 0 days.

(21) Appl. No.: 09/374,164

(22) Filed: Aug. 13, 1999

(51) Int. Cl.[7] ..... F24F 7/00
(52) U.S. Cl. ..... 454/359; 454/366; 454/367
(58) Field of Search ..... 454/359, 363, 454/366, 367, 5, 30, 41

(56) References Cited

U.S. PATENT DOCUMENTS 3,955,848 * 5/1976 Lutz et al. ..... 296/218
4,896,590 * 1/1990 Groos ..... 454/88
5,662,522 * 9/1997 Waltz ..... 454/359
5,762,551 * 6/1998 Lachapelle et al. ..... 454/359
5,860,256 1/1999 Humber ..... 52/219

FOREIGN PATENT DOCUMENTS 2129375 2/1996 (CA) .

* cited by examiner

*Primary Examiner*—Jiping Lu
(74) *Attorney, Agent, or Firm*—Shook, Hardy & Bacon L.L.P.

(57) ABSTRACT

A roof vent comprises two parts, a cover and a conduit. The conduit, with a pipeline already attached, can be easily connected to the cover, after the cover has been installed on a roof. The conduit will plug into the cover making installation easy. The vent includes a channel or moat which surrounds the outlet of the conduit. Thus, if during extreme weather conditions, moisture passes into the cover from outside through its opening and if it gets past the door flap, it will be trapped in the channel.

8 Claims, 9 Drawing Sheets

ROOF VENT

FIELD OF THE INVENTION

This invention relates to vents and in particular to roof vents.

BACKGROUND OF THE INVENTION

Vents, for venting gases, such as air, through the roof of a building are well known. Such vents are used in a wide variety of applications, including in the venting of air from a bathroom or from a stove in a kitchen. In such circumstances, the vent is interconnected by way of flexible or rigid piping or ducting to an exhaust fan, which draws the air from the location and forces it through the piping and out of the vent at the roof.

The air vent itself is generally comprised of several parts including a conduit which includes an inlet for a connection to the piping, and a cover. The cover, as its name indicates, covers the outlet of the conduit, assisting to prevent rain or snow from entering the conduit, which could then pass down the piping. Air vents also typically have a hinged door flap mounted within the cover, which pivot between a closed position, wherein the cover substantially covers the outlet, and an open position wherein the forced air exiting the conduit's outlet can pass out of the vent through the opening in the cover. Louvres or vanes mounted within the opening of the cover also serve to help inhibit water and snow from entering the pipeline by way of the roof vent.

Although the door flap and the louvres serve the purpose of inhibiting the movement of moisture into the pipeline, there are particular extreme weather conditions where a further barrier to the moisture is highly desirable. As the door flap merely rests against the base of the vent, and typically is only a plastic surface meeting and contacting a plastic surface under the weight of the door flap, there is no positive seal between the base and the flap. The same is true at the side and rear edges of the flap, in so far as there is no positive seal with the walls of the cover. Thus in conditions of hard, wind driven rain, it is not unusual for moisture to be driven through the cover opening and past the door flap, and may thus reach inside the pipeline.

It is highly undesirable to have moisture seep into the pipeline. Aside from the matter of an increased chance of corrosion of the pipeline, if it is made from a material that is susceptible to corrosion, there is also the risk that water might reach the exhaust fan or another electrical appliance and cause damage thereto. Accordingly, it is desirable to have a further means to inhibit the movement of water from outside the vent into the pipeline. However, it is important that any additional features not add significantly to the overall cost of manufacturing the roof vent.

The roof vents also have a way to permit the vent to be secured to the roof. Typically, the vent is placed in a hole in the roof and secured in position by connecting a base to the frame of the roof, placing flashing over the base and then the roof material, such as roof shingles, is put in place over the flashing. It is usually only after the roof has been put in place, that the connection of the pipeline to the inlet of the conduit can be, and is, made. This however is a somewhat difficult and awkward task for the installer, as he/she has to make a connection between two sections of pipe, usually requiring clamping etc. in a confined, raised space (eg. in the attic of the building). It is thus desirable to have an improved way of connecting a roof vent to a pipeline.

SUMMARY OF THE INVENTION

In accordance with the present invention, there is provided a vent for venting gas, said vent comprising a conduit having an inlet for connecting to a source of gas and an outlet for venting gas from said conduit, a barrier disposed around said out let, a cover for securing to a structure, said cover having a roof portion disposed over said outlet and said barrier, said cover having a side portion with a cover opening spaced from said outlet of said conduit, said cover opening adapted to permit said gas vented from said outlet to pass through said cover opening, said barrier being adapted to inhibit the movement of water from said cover opening into said conduit at said outlet.

According to another aspect of the invention, a roof vent for venting a gas, said vent comprising a conduit having an inlet for connecting to a source of gas and an outlet for venting said gas carried by said conduit, said conduit having a first connector, a cover for covering said outlet, said cover having a side portion with an opening for venting gas from said outlet, and a roof portion, said cover having a second connector for securing said cover to a roof, said cover further comprising a third connector adapted to cooperate with said first connector to permit said first connector of said conduit to be connected to said second connector of said cover such that said outlet can received within said cover, with said roof portion positioned above said outlet, in such a manner that when gas vented is from said outlet it can pass out of said opening.

According to a further aspect of the invention, a roof vent for venting a gas from a building, said vent comprising a conduit having an inlet for connecting to a source of gas and an outlet for venting said gas carried by said conduit, a cover adapted to cover said outlet of said conduit, said cover having a roof portion adapted to be positioned above said outlet and having opposed side walls for supporting said roof portion, each side wall having an inner face, each inner face having at least one slot, said cover having an opening for venting gas received within said cover from said outlet and a bottom opening between said side walls for receiving said conduit, said conduit further comprising a plate member positioned proximate said outlet, said plate having an outer face having a plurality of projections, said plate member being adapted to be received between said side walls in said bottom opening so as to engage at least one of said projections on said outer face of said plate member with each of said at least one slots on said inner faces of said side walls, to permit said conduit to be connected to said cover.

BRIEF DESCRIPTION OF THE DRAWINGS

In drawings illustrating the preferred embodiment of the invention.

DETAILED DESCRIPTION OF THE PREFERRED EMBODIMENT

Figure 1:
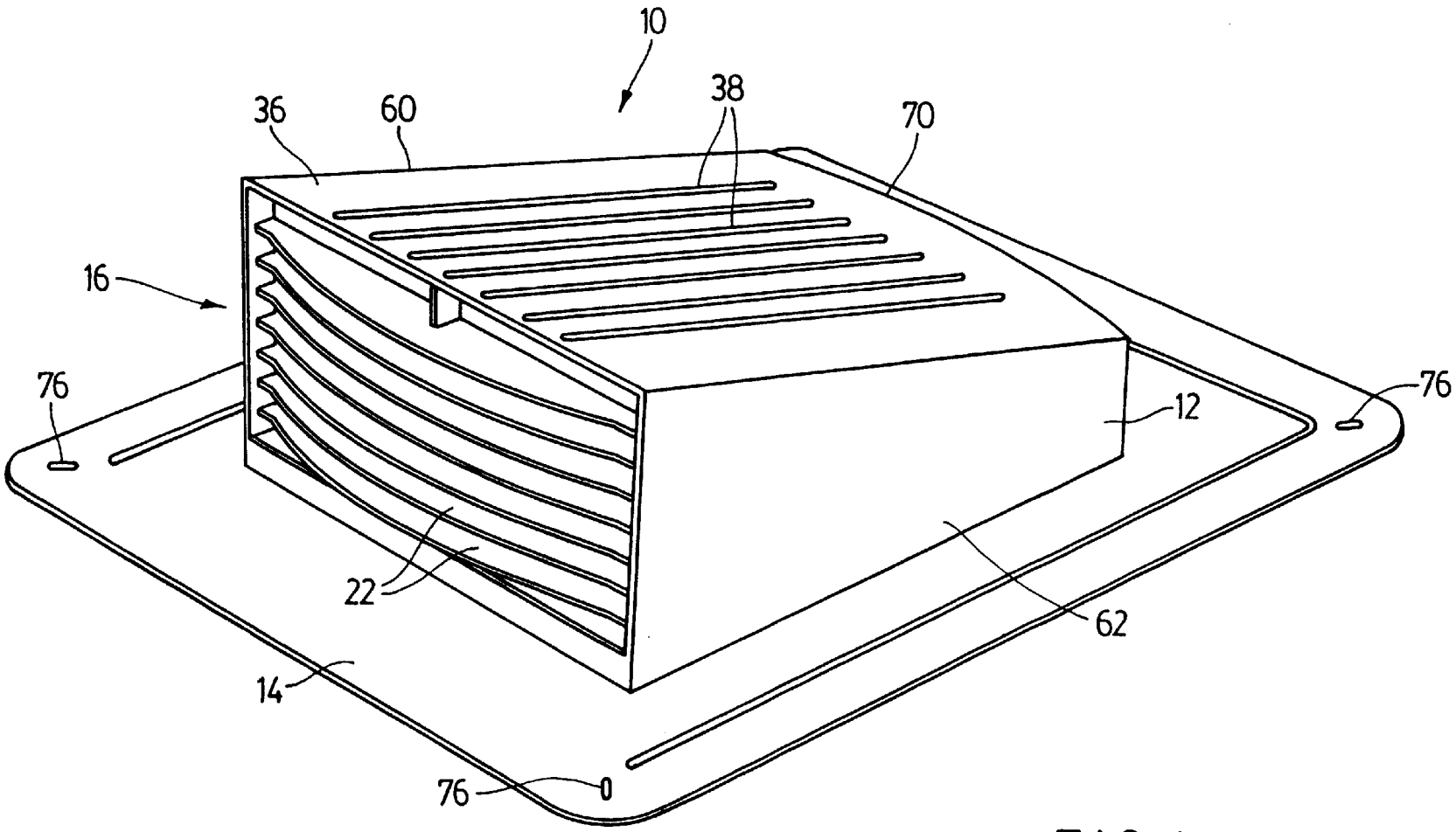
FIG. 1 is a front, right side perspective view of the preferred embodiment of the invention, and the opposite, front left side perspective view is a mirror image.
Figure 2:
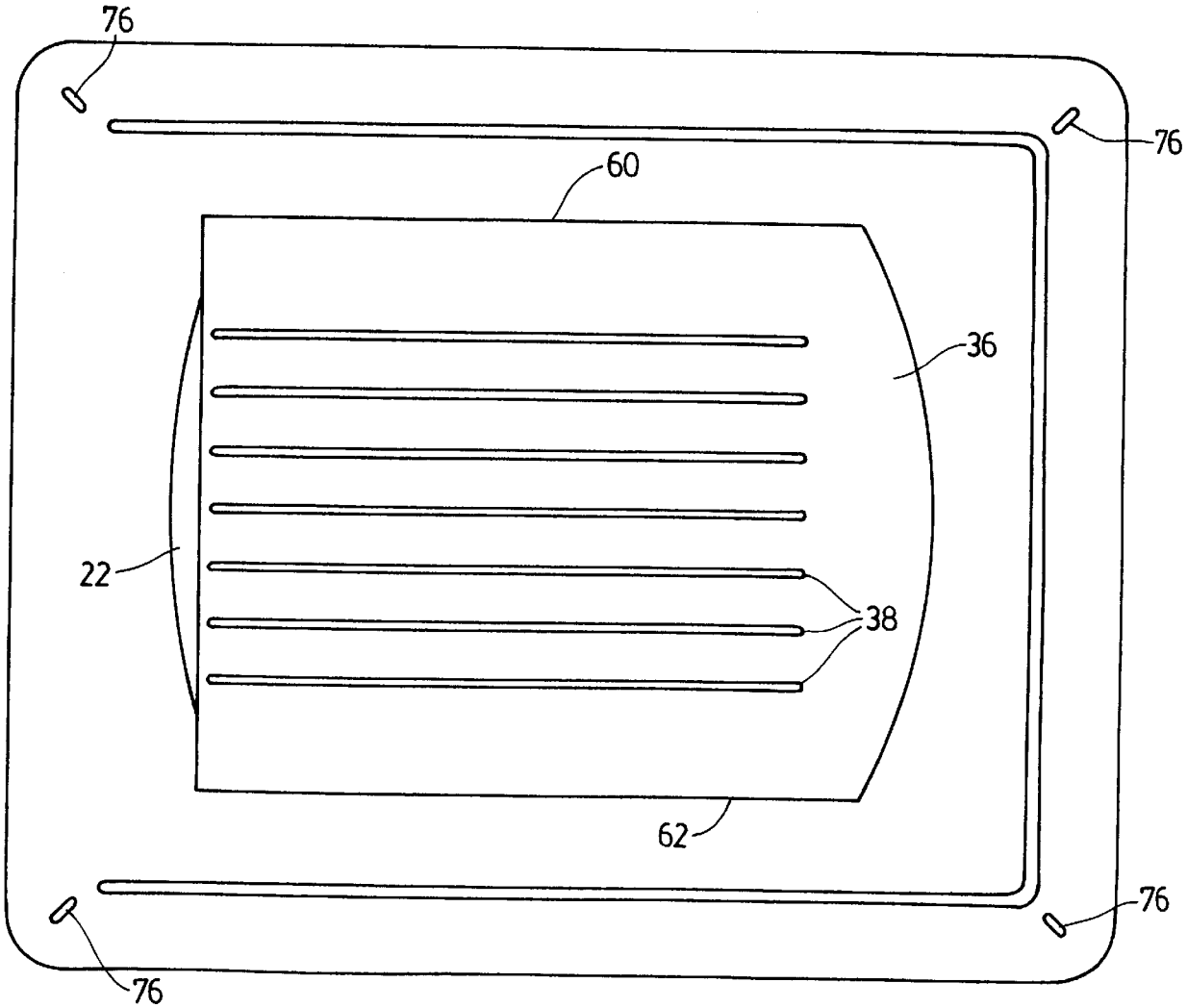
FIG. 2 is a top plan view of the vent of FIG. 1.
Figure 3:
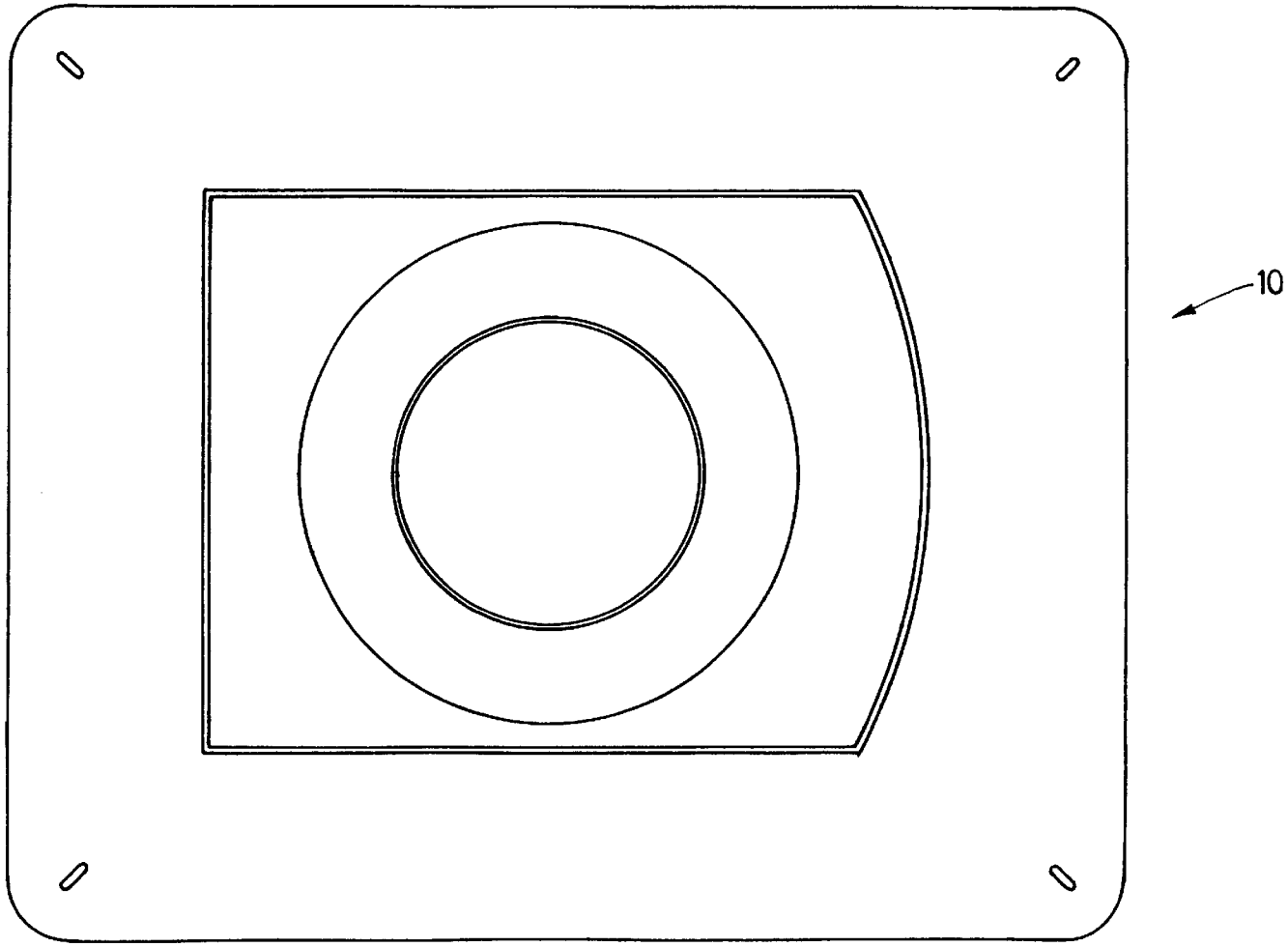
FIG. 3 is a bottom plan view of the vent.
Figure 4:
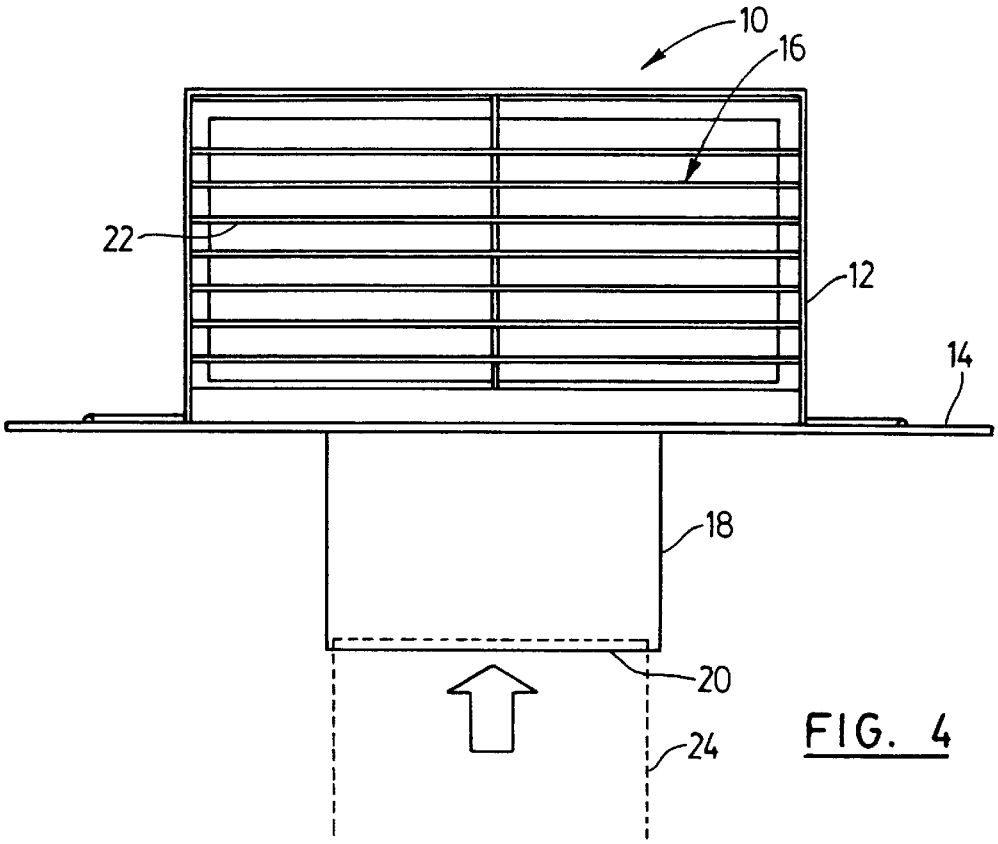
FIG. 4 is a front elevation view of the vent.

With reference to the Figures, a vent for gases generally designated 10 comprises a cover 12 having a front opening 16, a base 14 and a conduit 18. All components of vent 10 are preferably made from a flexible plastic material such as for example, polypropylene or polyethylene.

Figure 10:
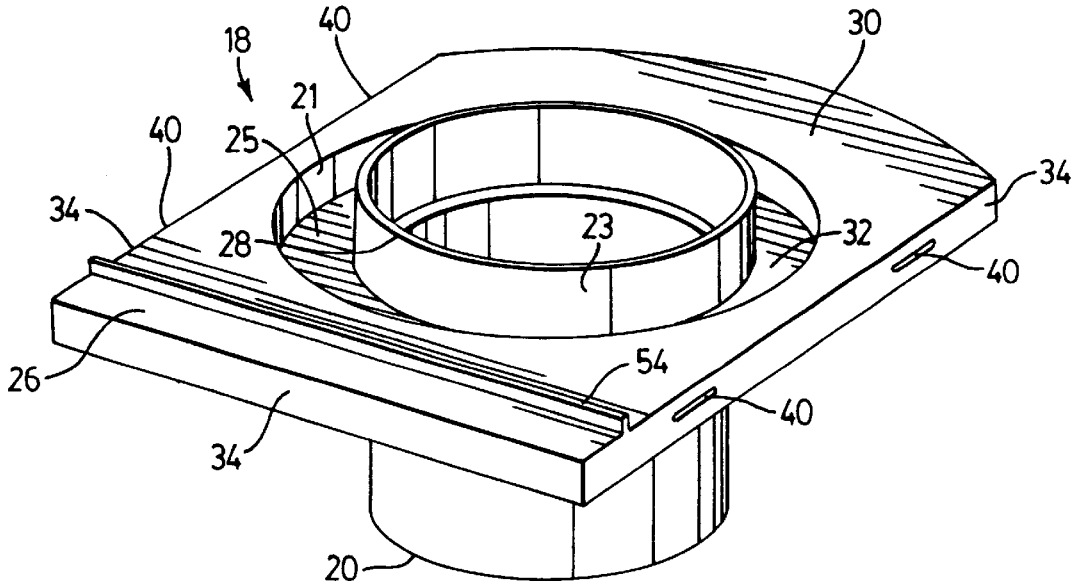
FIG. 10 is a front, right side perspective view of part of the vent of FIG. 1, and the opposite, left front side perspective view is a mirror image.

Conduit 18 is formed with a short pipe section 19 that has an inlet 20 and an outlet 28. Conduit 18 also has attached to it, or integrally formed therewith, a plate member 26 that is positioned proximate and surrounds outlet 28 (see FIGS. 7 and 10). As seen in FIG. 10, plate member 26 has an upward facing surface or floor 30 and a channel or moat 32 partly formed therein which surrounds outlet 28. Channel 32 has a side wall 21 and floor 25 formed in plate 26. The other side wall 23 of the channel is formed from the upper section of the outside surface of pipe section 19. The channel could of course be formed in other ways such as being formed wholly within and by plate 26.

Figure 7:
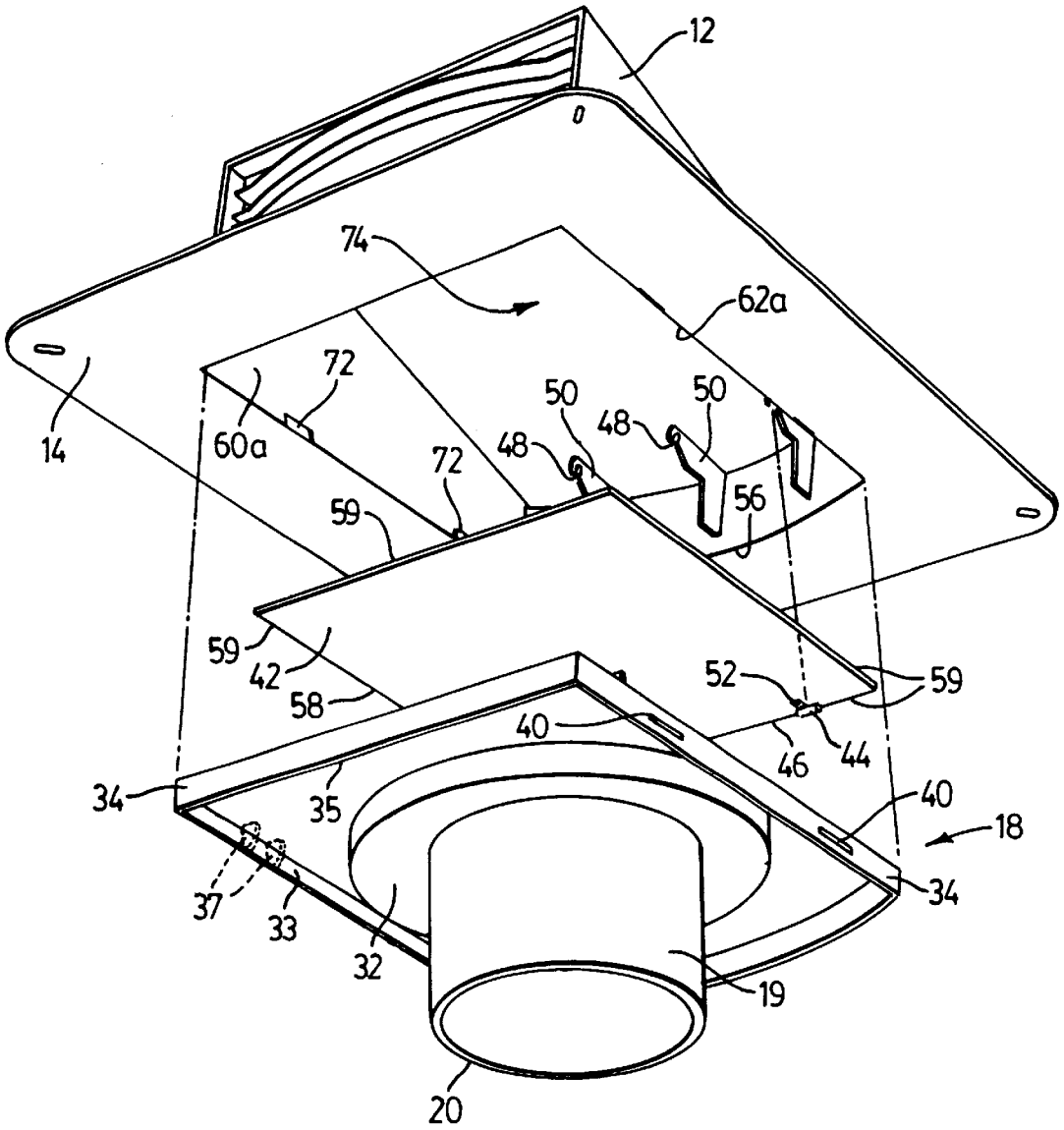
FIG. 7 is a front, right side partly exploded and partly separated perspective view from below of the vent, and opposite side exploded and separated perspective view is a mirror image.
Figure 8:
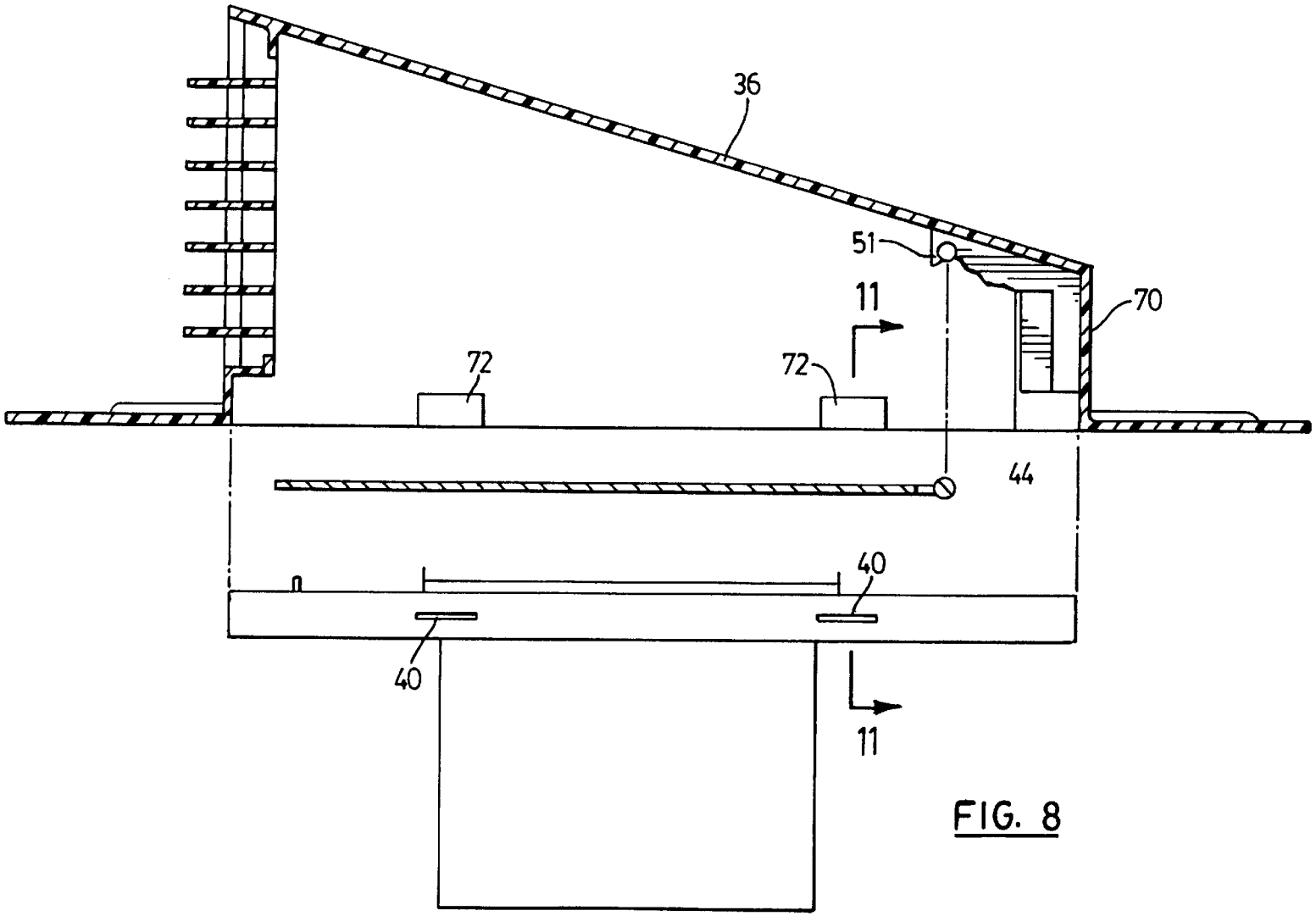
FIG. 8 is a side, cross sectional elevation view of the vent, partly exploded and partly separated.

All around the outside edge of plate 26 is a downward extending flange 35 having an outward facing peripheral face 34. Preferably, as shown in phantom in FIG. 7, abutting the inside surface of the bottom of the plate 26 and the inside surface 33 of flange 35 are a plurality of spaced triangular reinforcing elements 37, the purpose of which is to provide rigidity to flange 35 and so enhance the connection between surface 34 and the interior sides of cover 12, which is described below. In FIG. 7, only a few of elements 37 are shown, but elements 37 are spaced around the entire inside surface 33 of flange 35. On opposite side portions of side face 34 are a pair of longitudinally outward extending projections 40.

Figure 9:
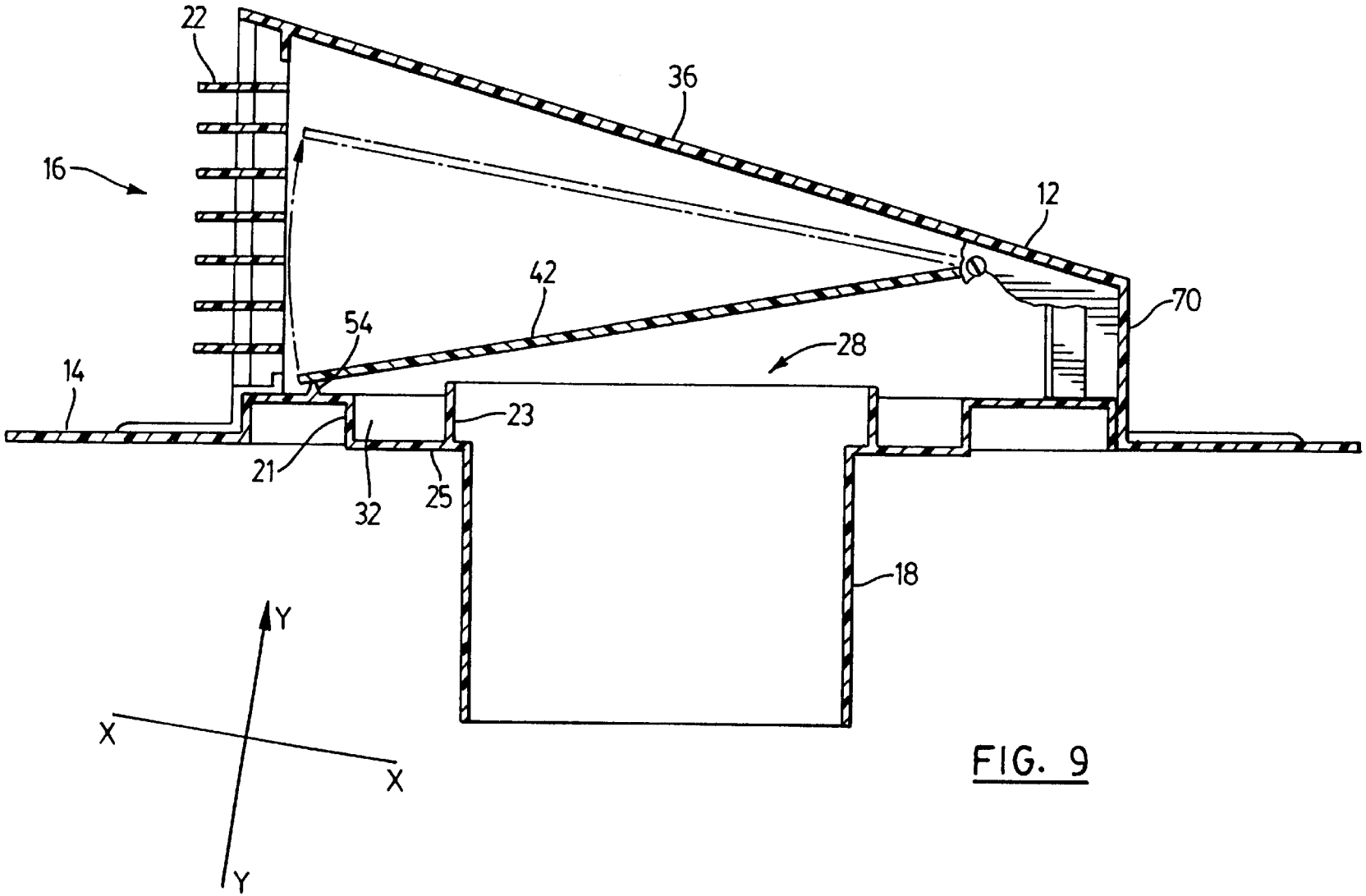
FIG. 9 is side, cross sectional elevation view of the vent.

Referring to FIG. 9, for reference purposes, axis x-x represents horizontal relative to the earth, and axis y-y is an orthogonal axis to x-x and which is completely vertical in a straight up direction relative to earth (ie. y-y is the direction in which gravity acts). Cover 12 has a roof portion 36, which is set at an angle relative to base 14 and horizontal axis x-x such that water on roof 36 will slope to the rear of the roof portion 36 and away from opening 16. Roof portion 36 has a plurality of longitudinally extending ribs 38 (FIG. 1) on its upper surface. Ribs 38 assist in directing moisture away from opening 16. Cover 12, when positioned on a slanted roof (not shown), has its opening 16 facing towards the bottom of the slanted roof. Cover 12 also has a plurality of slats or louvres 22 extending transversely across opening 16. These slats 22 are oriented in such a manner so as to assist in inhibiting snow and rain from passing through opening 16 towards outlet 28 of conduit 18.

Cover also has opposed side walls 60 and 62, and a rear wall 70. Formed within each of side walls 60 and 62 are a pair of slots 72 (FIG. 7), which are configured to receive projections 40 of plate 26. Positioned within cover 12 is a door flap 42, which in the preferred embodiment is generally square, or rectangular in shape. Formed along the rear edge 46 of flap 42 are a series of tubular or cylindrical protuberances 44. In front of each protuberance 44 is a longitudinal slot 52 through flap 42. Protuberances 44 are each received in an opening 48 of mounting brackets 50 that are spaced along the inside rear portion of cover 12. Flap 42 can pivot about protuberances 44 held in openings 48, between an outlet 28 covered or blocking position, as shown in solid lines in FIG. 9, and an outlet open position shown in broken lines in FIG. 9. Each of the front portions 51 of brackets 50 can move into and out of slots 52 in plate 26 during the pivoting movement Flap 42 has a peripheral edge, which comprises two side edges 56,58, a back edge and a front edge. The side edges 56 and 58 do come close to abutting or do abut the inside faces 60*a* 62*a* of side walls 60 and 62, respectively. The cover 12 in FIG. 9 is shown to have its base 14 oriented at angle relative to axis x-x to depict the orientation of the vent when positioned on an inclined roof. Along its entire length, the peripheral edge of flap 42 extends horizontally beyond the horizontal (x-x) position of the outer side wall 21 of channel 32, such that the flap completely covers channel 32.

In the outlet covering position, flap 42 rests on a transversely extending rib 54. The overall positioning of flap 42 when in the covered position is such that it will, in combination with slats 22, generally prevent most moisture passing into conduit 18. However, there is no positive seal between the underside of flap 42 and rib 54, nor between side edges 56 and 58 of the peripheral edge of flap 42 and the inside faces 60*a*, 62*a* of cover side walls 60, 62 respectively. Nevertheless, any moisture which seeps past the peripheral edge of flap 42 and drops vertically (y-y) down at the peripheral edge onto plate 26, or which seeps under flap 42 between the flap and rib 54, will reach plate 26 on the side of the channel 32 remote from outlet 28. Thus channel 32 provides a barrier preventing moisture reaching inside pipe section 19 of conduit 18. Channel 32 is configured and arranged such that any moisture that tends to seep towards outlet 28, for example from the rear portion of plate 26, will migrate into, and be captured by channel 32.

Other types of barriers that can be used as an alternative to channel 32, include a raised wall, or an absorbent material such as a sponge like material capable of soaking up moisture, both or which surround the outlet 28.

Figure 11:
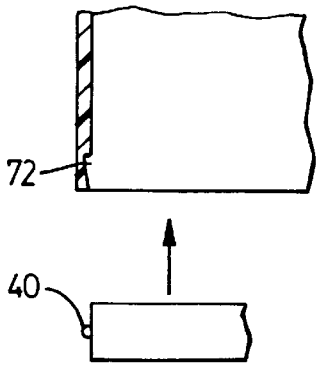
FIG. 11 is a cross sectional view at 11—11 in FIG. 8.
Figure 12:
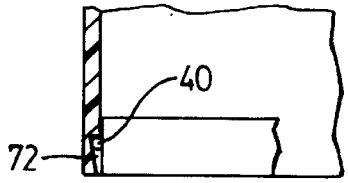
FIG. 12 is a cross sectional view similar to FIG. 11, but showing two parts of the vent interconnected with each other.

Conduit 18 including plate member 26, can be releasably attached to the cover 12 in the following manner. Plate 26 is receivable into base opening 74 with outer face 34 in abutment with the inner faces of cover 12, including the inner side faces 60*a* and 62*a*. The plate 26 can be positioned in such a manner that projections 40 can be moved into and received in interlocking relationship with slots 72 (see FIGS. 11 and 12). Many other types of connectors known to persons skilled in the art could be substituted for the projection and slot connection described above. For example clips having resilient arms and a hook element adapted to be received in a suitable slot could be used. Alternatively, a pure frictional connection between the outer surface 34 and the inside face that defines bottom opening 74.

Figure 5:
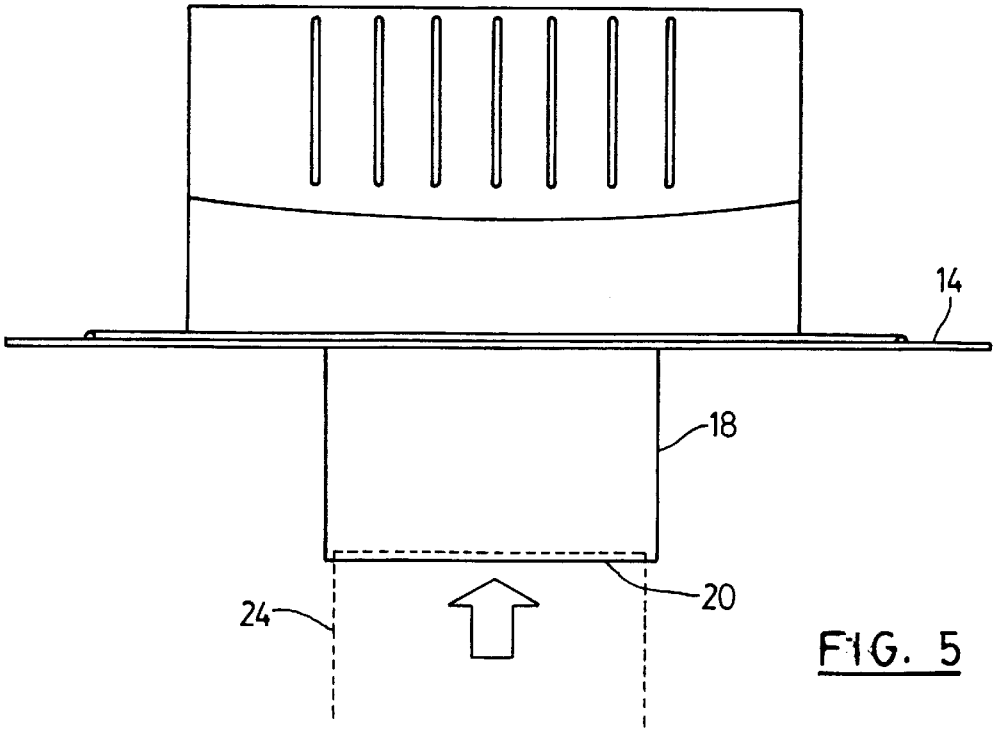
FIG. 5 is a rear elevation view of the vent.
Figure 6:
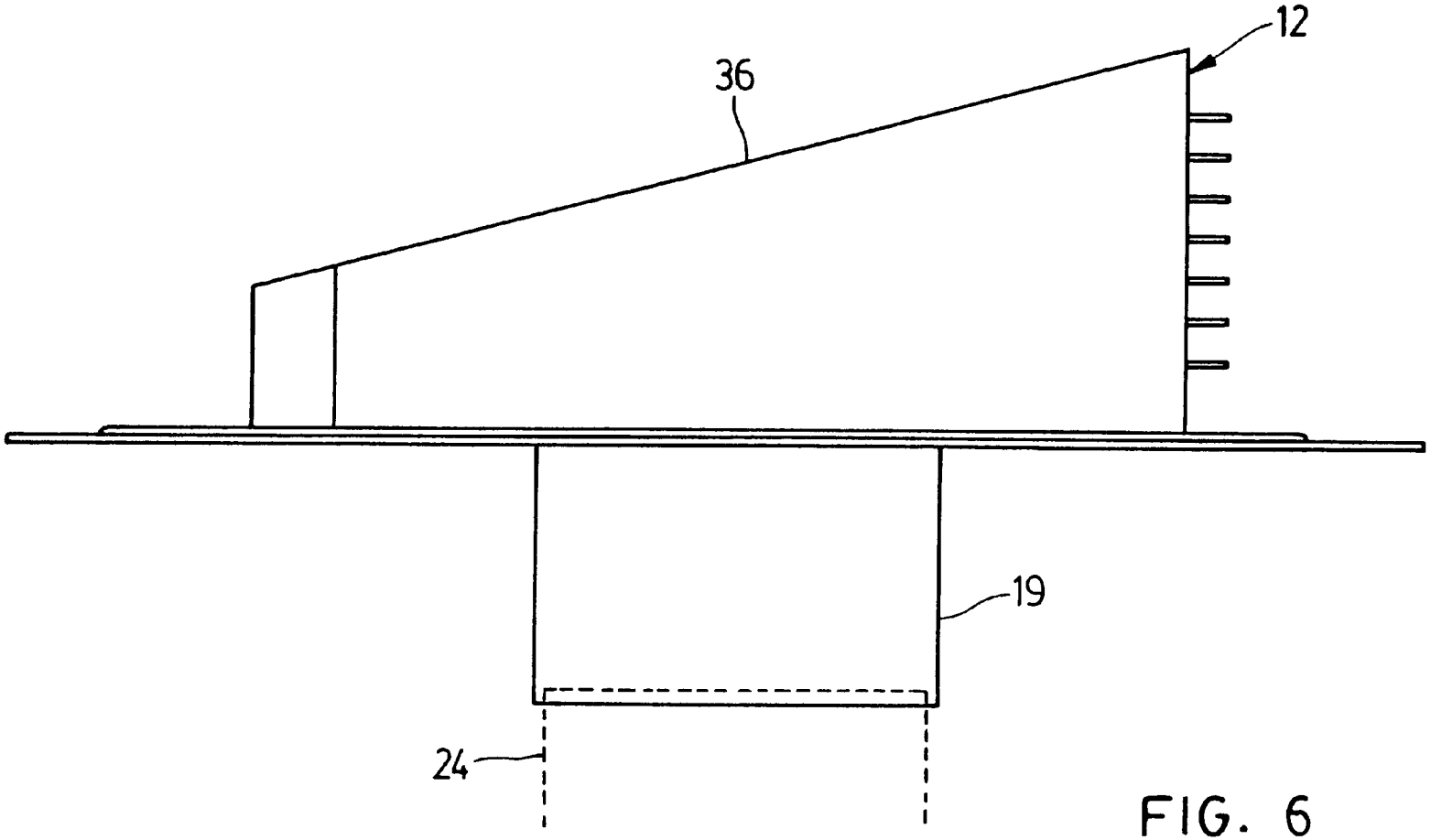
FIG. 6 is a left side elevation view of the vent and the right side elevation view is a mirror image.

Vent 10 is particularly suitable for placement on a building roof, and for connection by way of conduit 18 to a source of pressurized gas, such as air. Typically the source of gas might be a pipeline or hose 24 (FIG. 5) which is hooked up to the exhaust fan (not shown) such as for example one located in, or adjacent to, a bathroom, or to a range stove.

To install roof vent 10, first the cover 12 is attached to the roof frame, for example by driving nails through holes 76 into roof support members. Thereafter, flashing (not shown) is laid over the base 14 and then the roofing material, such as roof shingles, is secured over top of the flashing. Thus the cover 12 is secured to the roof, and is typically not moved again, at least until the roofing material is changed. Thereafter, at an appropriate time, pipeline 24 can be connected to the inlet 20 of conduit 18, while conduit 18 is detached from cover 12. This connection, which may involve using one or more of clamps, duct tape, staple and adhesive. However, this connection can be effected relatively easily, as conduit 18 and pipeline 24 can be connected together at ground level. Thereafter, it only remains to "plug" conduit 18 into cover 12 by means of placing plate member 26 into position in opening 74 and ensuring projections 40 are received in slots 72.

If it is desired to disconnect pipeline 24 from vent 10, this can be easily accomplished by simply prying one or both of the side walls outward, thus releasing projections 40 from slots 72, and providing sufficient clearance between the projections and the slots to "unplug" conduit 18 from cover 12.

Once operational, the exhaust fan in communication with pipeline 24, will from time to time, draw air from the bathroom or stove area, and force it into pipeline 24. The air will then pass through the pipeline 24 and will then enter conduit 18 at inlet 20. Passing through pipeline section 19 and exiting at outlet 28, the pressure will force flap 42 into an open position. It will be difficult for moisture to penetrate outlet 28 when air is being forced out of the conduit and out cover opening 16, because of air pressure blowing moisture away. However, when the exhaust fan is not operating, under extreme moisture conditions, moisture may pass through opening 16 and seep past flap 42. However, this moisture will be trapped in channel 32. Thereafter, once the extreme weather has subsided, any moisture captured in channel 32 will evaporate. The evaporation process of moisture from channel 32 is aided by forced air blowing over the channel, when the exhaust fan is operational.

Various modifications to the forgoing preferred embodiment are possible which are within the scope of the invention as hereinafter claimed.

We claim:

1. A vent for venting gas, said vent comprising:

a conduit having an inlet for connecting to a source of gas and an outlet for venting gas from said conduit, a barrier disposed around said outlet, a cover for securing to a structure, said cover having a roof portion disposed over said outlet and said barrier, said cover having a side portion with a cover opening spaced from said outlet of said conduit, said cover opening adapted to permit said gas vented from said outlet to pass through said cover opening, a flap disposed within said cover, said flap mounted for pivoting movement between a first position wherein said flap substantially blocks said outlet, and a second position wherein said flap permits said gas to pass from said outlet and vent through said cover opening, said barrier being adapted to inhibit the movement of water from said cover opening into said conduit at said outlet, an outer peripheral edge of one of said roof portion and said flap extending beyond an outer peripheral edge of said barrier so that moisture draining from said one of said roof portion and said flap drains at a side of said barrier opposite said outlet.

2. A vent as claimed in claim 1, wherein said barrier comprises a channel formed around said outlet.

3. A vent as claimed in claim 2 wherein said channel completely surrounds said outlet.

4. A vent as claimed in claim 3 wherein said channel is integrally formed with said conduit and is positioned proximate said outlet.

5. A vent as claimed in claim 3 wherein said outer peripheral edge of said flap extends beyond the outer edge of said channel along its entire length.

6. A vent as claimed in claim 5 wherein said conduit includes a substantially flat plate extending proximate said outlet and away from said outlet, and said channel is formed at least partially within said plate.

7. A vent as claimed in claim 3 wherein said flap outer peripheral edge is disposed, wholly on the side of the channel remote from said outlet.

8. A roof vent for venting a gas from a building, said vent comprising:

a conduit having an inlet for connecting to a source of gas and an outlet for venting said gas carried by said conduit, a cover adapted to cover said outlet of said conduit, said cover having a roof portion adapted to be positioned above said outlet and having opposed side walls for supporting said roof portion, each side wall having an inner face, each inner face having at least one slot, said cover having an opening for venting gas received within said cover from said outlet and a bottom opening between said side walls for receiving said conduit, said cover further having a base with a plurality of holes adapted for reception of fasteners for securing said cover to a roof, said conduit further comprising a plate member positioned proximate said outlet, said plate having an outer face having a plurality of projections, said plate member being adapted to be received between said side walls in said bottom opening so as to engage at least one of said projections on said outer face of said plate member with each of said at least one slots on said inner faces of said side walls, to permit said conduit to be connected to said cover.

* * * * *